US007260958B2

(12) United States Patent
Huang

(10) Patent No.: US 7,260,958 B2
(45) Date of Patent: Aug. 28, 2007

(54) ELECTROHYDRODYNAMIC CONDENSER DEVICE

(75) Inventor: Po-Chuan Huang, Taipei (TW)

(73) Assignee: National Taipei University Technology, Taipei (TW)

( * ) Notice: Subject to any disclaimer, the term of this patent is extended or adjusted under 35 U.S.C. 154(b) by 188 days.

(21) Appl. No.: 11/225,167

(22) Filed: Sep. 14, 2005

(65) Prior Publication Data

US 2007/0056315 A1 Mar. 15, 2007

(51) Int. Cl.
*F25B 39/04* (2006.01)
*F28D 15/00* (2006.01)

(52) U.S. Cl. ..... 62/506; 165/104.23

(58) Field of Classification Search ..... 62/181, 62/183, 305, 478, 498, 506; 165/104.23, 165/104.24, 104.25, 302; 361/230, 233
See application file for complete search history.

(56) References Cited

U.S. PATENT DOCUMENTS 4,396,055 A * 8/1983 Mitchell, Jr. ..... 165/104.23
6,374,909 B1 * 4/2002 Jeter et al. ..... 165/96
6,409,975 B1 * 6/2002 Seyed-Yagoobi et al. ... 422/186
6,582,500 B1 * 6/2003 Ohadi et al. ..... 96/61
6,810,946 B2 * 11/2004 Hoang ..... 165/104.26
2002/0056546 A1 * 5/2002 Judge et al. ..... 165/96
2003/0110790 A1 * 6/2003 Cheng et al. ..... 62/272
2003/0111214 A1 * 6/2003 Seyed-Yagoobi et al. ..... 165/109.1
2006/0005946 A1 * 1/2006 Borgstrom et al. ..... 165/96

FOREIGN PATENT DOCUMENTS

SU 706672 A * 12/1979

* cited by examiner

*Primary Examiner*—Mohammad M. Ali

(57) ABSTRACT

An electrohydrodynamic (EHD) condenser device includes a condenser installed with an EHD electrode. An electric field is generated upon a fluid of low conductivity inside a compressor device and an enhanced thermal conduction effect is then achieved since the electric field induces current convection, migration and deformity of bubble, increases perturbation and mixture of the flow field and eliminates boiling and delay. With the EHD utilized, size, weight, cost and required refrigerant amount of the condenser device are reduced. Further, thermal conduction efficiency of the alternative refrigerant is improved, making the EHD compensator device in compliance with associated refrigerant regulations made by CFC and achieve the purposes of environmental protection and energy saving.

23 Claims, 6 Drawing Sheets

ELECTROHYDRODYNAMIC CONDENSER DEVICE

BACKGROUND OF THE INVENTION

1. Field of the Invention

The present invention pertains to an electrohydrodynamic (EHD) condenser device, and particularly to an EHD condenser device having an enhanced thermal transport efficiency through generating an EHD effect by using of an electrode.

2. Description of the Prior Art

To improve thermal exchange efficiency of a compressor, increased surface area, a number of compressor tube are generally suggested. For example, threads may be added to an interior wall of the thermal exchanging tube to enhance the thermal exchange efficiency. However, this manner may only increase the thermal exchange efficiency passively with results of limited heat exchange effect, prolonged process time and larger volume and weight of the compressor. Such evaporator may be seen in, for example, R. O. C. patent no. 531630. In this patent, a disclosed compressor is characterized in that one or more compartments are formed vertically in an area where a thermal exchanging tube is disposed in prevention of liquid refrigerant deposited around the thermal exchanging tube and for speeding up a gaseous refrigerant in-flow.

In another patent, R. O. C. patent no. 526322, a refrigerant tube of a thermal exchanger is disclosed. This refrigerant tube is characterized in that a plurality of heat sinking pieces are combined so that the refrigerant flown in the tube and air surrounding thereto may thermally exchange with each other.

However, this refrigerant tube has the following disadvantages as follows.

1. Only a passive improvement in structure is provided and the heat exchange efficiency may not be self-controlled.

2. Since the condenser may only be improved in structure, dimension, volume and weight of the condenser may not be efficiently reduced.

3. Partial cooling function may not be achieved.

4. The amount of the refrigerant required for the condenser may not be reduced.

In view of these problems encountered in the prior art, the Inventors have paid many efforts in the related research and finally developed successfully an electrohydrodynamic (EHD) condenser device, which is taken as the present invention.

SUMMARY OF THE INVENTION

It is, therefore, an electrohydrodynamic (EHD) condenser device capable of actively controlling heat transport efficiency of refrigerant used therein.

It is another object of the present invention to provide an EHD condenser device having a reduced dimension, volume and weight.

It is yet another object of the present invention to provide an EHD condenser device which may achieve a partial cooling function.

It is still another object of the present invention to provide an EHD condenser device having a reduced amount of refrigerant required therefore.

The EHD condenser device according to the present invention comprises a condenser being a case having a plurality of openings thereon and a plurality of metal tubes therein, a working fluid being a fluid of low conductivity, a voltage applicable insulator comprising a voltage application end and a voltage applicable insulation seat and inputtable by a high voltage and one or more electrodes disposed in the working fluid and used to generate an electric field. The working fluid is filled between an interior wall of the condenser case and an exterior wall of the metal tube and the electrode is disposed in the working fluid and connected to the voltage application insulation seat at one end, the voltage applicable insulator being installed at an opening of the condenser case so as to be connected to a high voltage power supplying device.

DETAILED DESCRIPTION OF THE PREFERRED EMBODIMENT

Figure 1A:
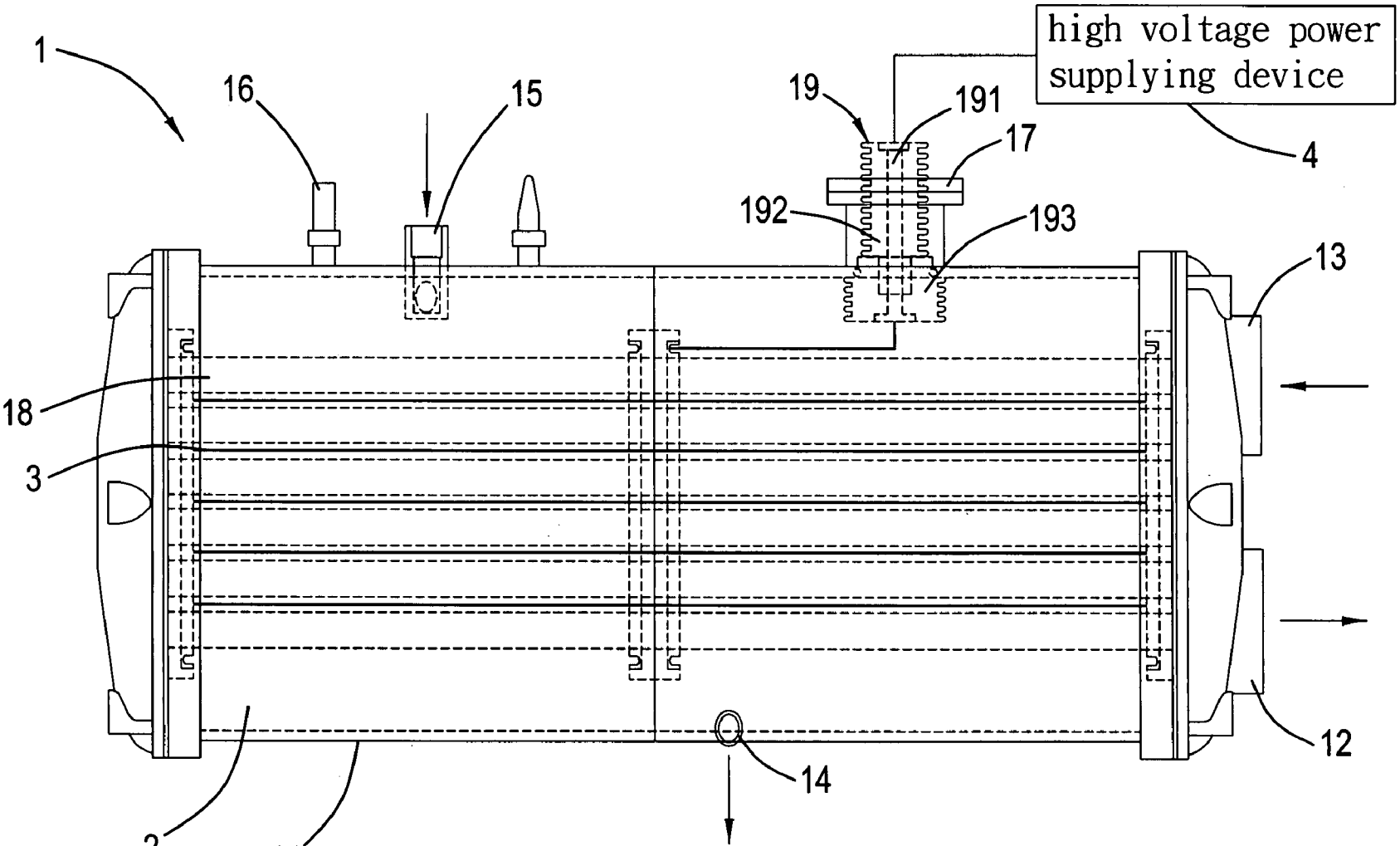
FIG. 1A is a structural diagram of an electrohydrodynamic (EHD) condenser device according to the present invention.

Referring to FIG. 1A, a structural diagram of an electrohydrodynamic (EHD) condenser device according to the present invention is shown therein. The EHD condenser device comprises a condenser 1 being a case 11 having a plurality of openings. These openings are served as an amount 17 for any of a cooling water inlet/outlet, a refrigerant inlet/outlet and a safety valve 16 or a voltage applicable insulator. The case has a plurality of metal tubes disposed therein. In this embodiment, copper tubes 18 are utilized, each having macro-fins having interior threads formed on its interior wall and being smooth on its exterior wall. These copper tubes 18 are arranged in an orthogonal relationship and served as a ground electrode (negative electrode). The condenser is filled with a working fluid of low conductivity, which is refrigerant 2 in this embodiment. A voltage applicable insulator 19 comprises a voltage application end and an insulation portion. In this embodiment, a conducting rod 191 is provided to have a threaded case 192 of Telfon at an exterior wall thereof. The conducting rod 191 has a protrusion mated with an indentation portion of an insulation seat 193 for high voltage application to form the whole body of the voltage applicable insulator 19. One or more corrugated electrodes (positive electrodes) 3 have refrigerant flowing around and are fixed in position by a Teflon-made insulation seat, which prevents a long and thin electrode from breaking off. Further, the Telfon-made insulation seat may prevent the electrode (positive electrode) and the copper tube (negative electrode) from contacting with each other and thus an electric field may be generated. The voltage applicable insulator 19 amounted at an opening of the condenser case 11 so as to connect to a high voltage power device 4.

Figure 1B:
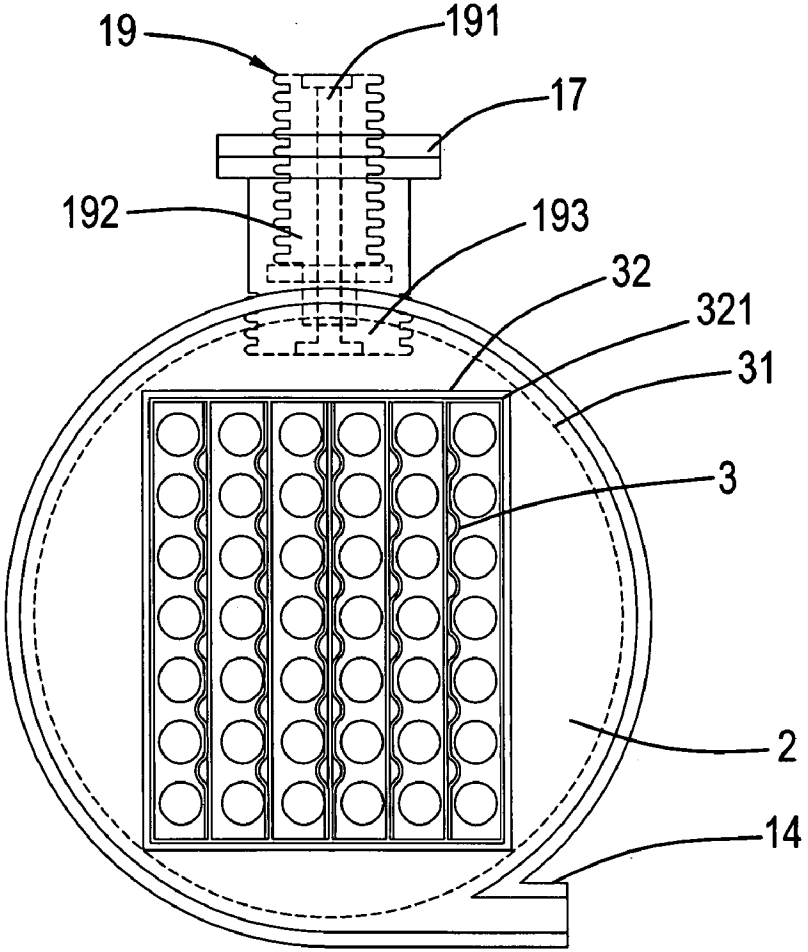
FIG. 1B is a cross sectional view of the EHD condenser device according to the present invention.

In real operation, refrigerant is fed and filled into the condenser between an interior wall of the case 11 and an exterior wall of the copper tube 18 through a refrigerant inlet 15. Cooling water is instilled into the copper tubes 18 through a cooling water inlet 12. As such, the cooling water is flown in the copper tubes 18 and outside which the refrigerant is flown. Then, the high voltage power device 4 is turned on so as to provide a voltage to the electrode through a conducting rod 191 of the voltage applicable insulator 19, an iron-made insulation seat frame 31 and an electrode integration piece 32 (refer to FIG. 1B, a cross sectional view of the EHD condenser device) so as to achieve the purpose of generating the electric field upon the refrigerant.

When a high voltage difference (about 10 to 100 kV) is existed between the electrode 3 (positive electrode) 3 and copper tube (negative electrode) 18, corona discharge occurs so that gaseous refrigerant between the two electrodes are ionized, in which positive ions transmitted momentum to neutral atoms so that an enhanced convention effect occurs with respect to a flow field of the refrigerant. As such, heat transferred from the gaseous refrigerant to the cooling water is promoted in efficiency, the gaseous refrigerant returns to its liquid form and flows out the refrigerant outlet 14 and the cooling water leaves out the cooling water outlet 13. With related to the corona discharging, the thus generated gas has a speed of about 2 m/s and a thermal conduction coefficient of about 10 times that of general gas. In summary, since the generated electric field induces convection, perturbation, speedy nucleation and separation between the gaseous form and the liquid form, the purpose of enhanced thermal conduction efficiency is considerably achieved.

Figure 1C:
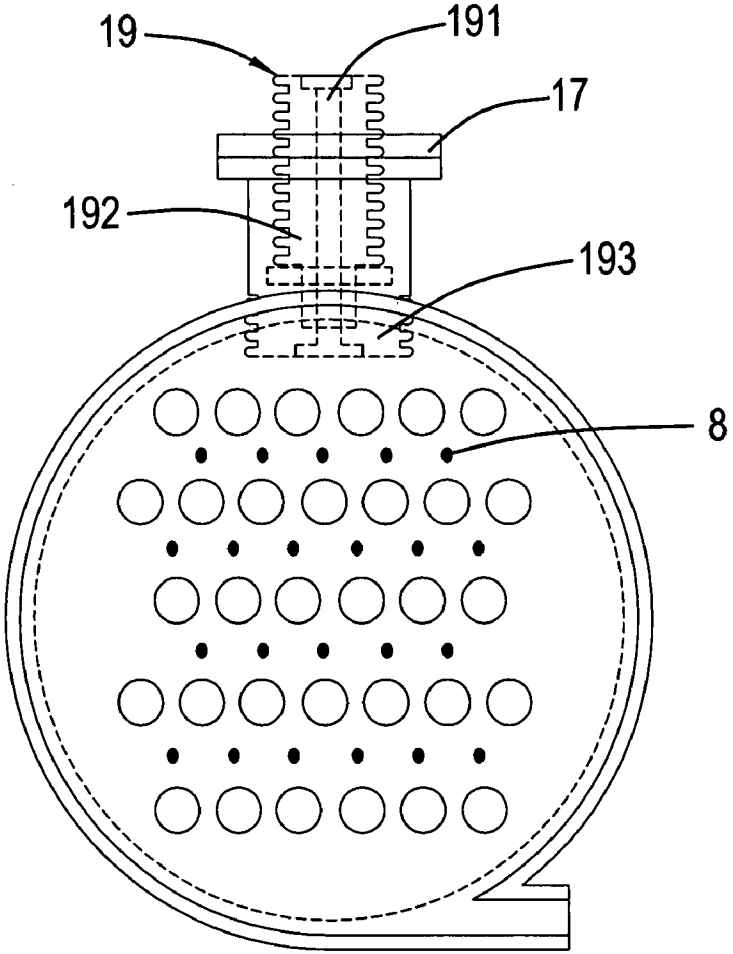
FIG. 1C is a cross sectional view of the EHD condenser device according to the present invention where electrode lines are disposed among alternatively arranged tube nests.
Figure 1D:
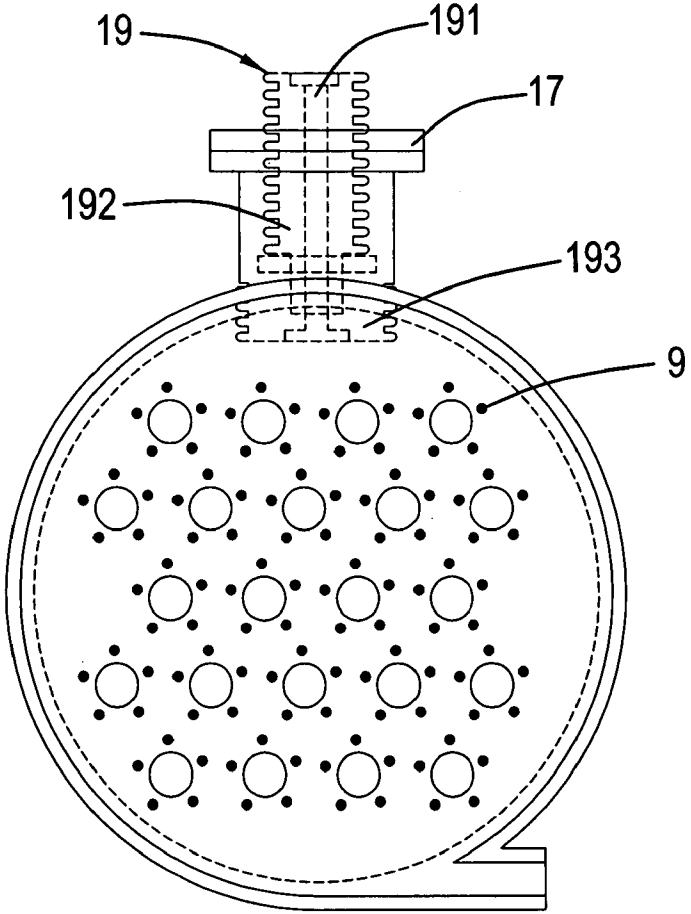
FIG. 1D is a cross sectional view of the EHD condenser device according to the present invention where the electrode lines are disposed circumferentially with respect to the tube nests.

Alternatively, the electrode may be arranged among alternatively disposed tube nests but not the orthogonally disposed metal tubes. The electrodes 8 of line shape are disposed between adjacent tube lines (refer to FIG. 1C) or circumferentially with respect to the tube lines 9 (refer to FIG. 1D).

Figure 2:
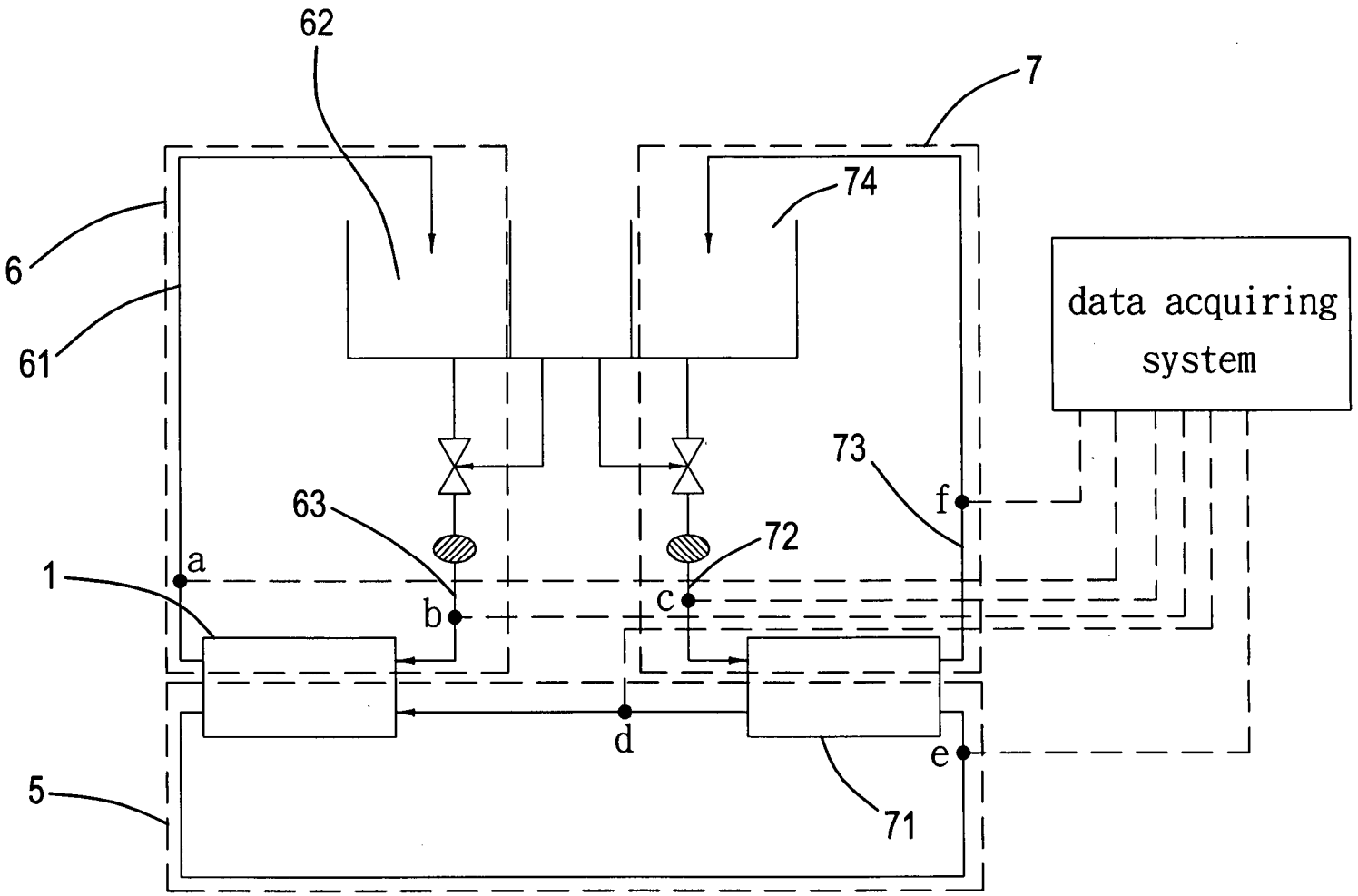
FIG. 2 is a schematic diagram illustrating an EHD evaporator iced-water mainframe comprising the EHD condenser device according to the present invention.

Referring next to FIG. 2, a schematic diagram of an iced water mainframe refrigeration system according to the present invention is shown therein. The iced water mainframe refrigeration system is composed of an iced-water mainframe refrigerant circulation system 5, a cooling water circulation system 6 and an iced-water circulation system 7. When the testing system performs, the cooling water in the condenser receives heat transmitted from the gaseous refrigerant (the cooling water flows within the copper tubes while the refrigerant at the high voltage side flows between outside the copper tubes and the iron case).

The 32° C. water 61 is delivered to a cooling water tower 62 by means of a cooling water pumping 61 and cooled down in the water tower 62 as 27° C. cooling water 63 and then returned to the condenser 1. In this manner, the cooling water circulation system 6 operates. In an EHD evaporator 71, the iced water transmits heat to the low pressure refrigerant in the evaporator, through which the 12° C. water 72 is reduced in temperature to become 7° C. water 73. Then, the water is directed to a constant temperature water trough 74 and then drawn into the evaporator 71 by an iced water pumping. Based on this principle, the cooling water circulation system 7 operates.

To test refrigeration performance (kJ/h) of the iced-water mainframe when the EHD evaporator is operated under some conditions, parameters associated therewith have to be measured, such as cooling water circulation amount at points a and b in FIG. 2, iced water circulation amount (m3/h) at points c and f, temperature (° C.) and temperature difference of the cooling water when entering and leaving the condenser, jet pressure (bar) of the refrigerant from the compressor, temperature of a drawing port of the refrigerant (° C.) at point d in the condenser, temperature of the outlet of the liquid refrigerant at point e in the condenser (° C.), temperature of the inlet of the refrigerant and pressure of the inlet of the refrigerant in the evaporator, among other.

Now the description will be made to a measurement operation of the iced-water mainframe performance testing system.

1. After the mainframe is initialized, the operation of the mainframe is tested. When the mainframe is stably operated with a full load presented, temperature of the cooling water when entering and leaving, temperature of the iced water when entering and leaving, circulation amount of the cooling water, circulation amount of the iced water, consumption power of a compressor and the like are measured and recorded.
2. When the mainframe is operated to the full load being presented, the high voltage power device 4 is enabled and maintained at a specific high voltage. When the high voltage is applied on the iced water mainframe, the operation thereof is observed and the high voltage is adjusted. Further, an upper and lower pressure and the circulation amount of the refrigerant are recorded.
3. Increasing the EHD voltage several times, then recording the associated data until spark discharge occurs.
4. To observe the operation when a partial load is presented, temperature of the iced water at the outlet is adjusted higher or lower. Then, a high voltage is applied and the operation is observed and recorded.

Figure 3:
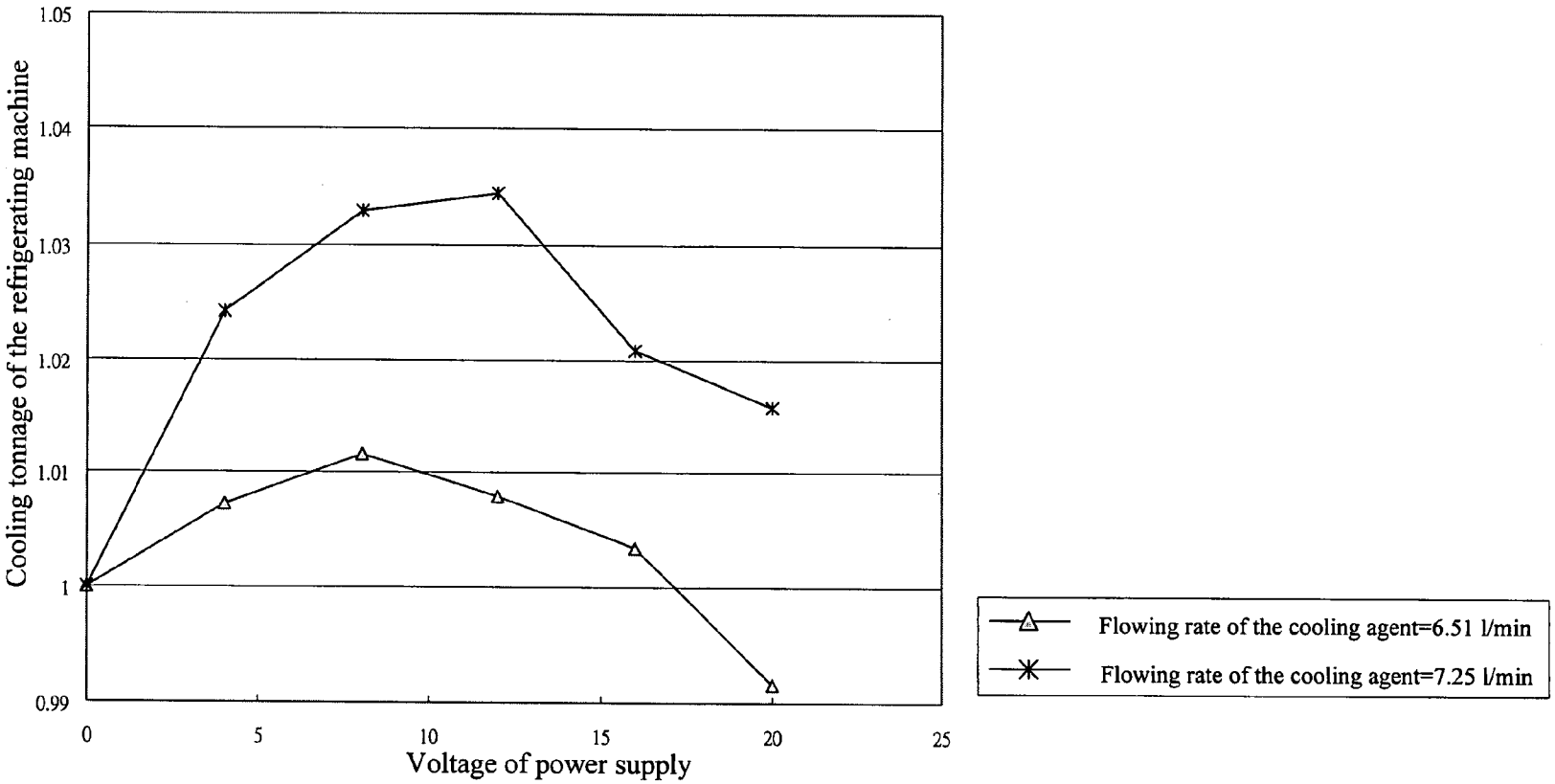
FIG. 3 is a relationship plot of an EHD voltage and refrigeration performance of the iced water mainframe according to the present invention.

Referring to FIG. 3, a relationship plot of the EHD voltage and refrigeration tones (RT) is shown therein. As shown, it may be known that the refrigeration performance increases as the input voltage increases when the refrigerant amount is kept constant. When the voltage is up to about 12 kV, the refrigeration tones (RT) reaches to a maximum (an increase of 4%) and then reduces slightly until the voltage reaches 20 kV.

The refrigeration tones of the iced water mainframe increases is because the applied EHD voltage makes the condensed liquid refrigerant outside the copper tubes in the condenser easy to come off from the copper tubes and the gaseous refrigerant has an increased condensation area and thus the gaseous refrigerant may rapidly condense. Thus, liquid refrigerant of lower temperature is presented at the outlet of the condenser. The flattened increase rate occurred when the voltage is further increased is because dryness of the refrigerant in the condenser reduces gradually and thus separation of the liquid and gaseous refrigerant becomes lesser.

When reaching 20 kV, the inputted voltage may not increases again since breakdown (short circuit) is occurred in the condenser. In conclusion, the refrigeration performance of the iced water mainframe increases as the applied voltage kV increases. Further, when the refrigerant amount increases, the refrigeration performance increases more significantly.

As compared to the prior art, the EHD condenser device disclosed in the present invention further has the following advantages.

1. The structure and installation method of the EHD evaporator device are simpler and power consumption thereof is lesser, compared with other active thermal conduction enhancement technologies.

2. A relatively lower cost is required since only a transformer, a wire and plate electrode and an insulation material is required.
3. The thermal conduction efficiency may be rapidly controlled by adjusting strength of the electric field applied on the EHD evaporator device.
4. Flow field or cooling effect may be partially improved in the delivery tubes.
5. The EHD technology may be used for the CFC refrigerant, other alternative refrigerants, such as R-123, R-134a, and gas (owing to the low conductivity).
6. The EHD evaporator device may be used even in outer space environment where gravity is not existed.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims and their equivalents.

What is claimed is:

1. An electrohydrodynamic (EHD) condenser device, comprising:

a condenser being a case having a plurality of openings thereon and a plurality of metal tubes therein;

a working fluid being a fluid of low conductivity; and a voltage applicable insulator comprising a voltage application end and a voltage applicable insulation seat and inputtable by a high voltage and one or more electrodes disposed in the working fluid and used to generate an electric field, wherein the working fluid is filled between an interior wall of the condenser case and an exterior wall of the metal tube and the electrode is disposed in the working fluid and connected to the voltage applicable insulation seat at one end, the voltage applicable insulator being installed at an opening of the condenser case so as to be connected to a high voltage power supplying device.

2. The EHD condenser device according to claim 1, wherein a material of the metal tube in the condenser comprises copper.

3. The EHD condenser device according to claim 1, wherein the metal tube in the condenser has an interior wall manufactured as micro-fins having interior threads.

4. The EHD condenser device according to claim 1, wherein the metal tube in the condenser is served as a ground end.

5. The EHD condenser device according to claim 1, wherein the working fluid has a dielectric constant of 6 to 30.

6. The EHD condenser device according to claim 1, wherein the working fluid is refrigerant.

7. The EHD condenser device according to claim 1, wherein the voltage applicable insulator is a conducting rod having a Telfon-made threaded case, the conducting rod having a protrusion mated with an indentation of an voltage application insulation seat so as to form a whole body of the voltage applicable insulator.

8. The EHD condenser device according to claim 1, wherein a material of the insulation seat of the voltage applicable insulator comprises Teflon.

9. The EHD condenser device according to claim 1, wherein the insulation seat of the voltage applicable insulator has a maximum bearable voltage of up to 40 kV.

10. The EHD condenser device according to claim 1, wherein the insulation seat of the voltage applicable insulator has a maximum bearable refrigerant pressure of up to 20 bar.

11. The EHD condenser device according to claim 1, wherein a shape of the electrode comprises a rod shape.

12. The EHD condenser device according to claim 1, wherein a shape of the electrode comprises a corrugated shape.

13. The EHD condenser device according to claim 1, wherein a shape of the electrode comprises a line shape.

14. The EHD condenser device according to claim 1, wherein a shape of the electrode comprises a spiral shape.

15. The EHD condenser device according to claim 1, wherein a shape of the electrode comprises a tube shape having a small diameter.

16. The EHD condenser device according to claim 1, wherein a shape of the electrode comprises a spiral and line mixed shape.

17. The EHD condenser device according to claim 1, wherein the electrode has a plurality of shapes presented concurrently.

18. The EHD condenser device according to claim 1, wherein the insulation seat has a metal frame for fixation of the insulation seat in the condenser case and an electrode integration piece through which the electrode and the voltage applicable insulator are contacted with each other.

19. The EHD condenser device according to claim 1, wherein the electrode is a copper line.

20. The EHD condenser device according to claim 1, wherein the electrode is a yellow copper plate.

21. The EHD condenser device according to claim 1, wherein the electrode is made of stainless iron.

22. The EHD condenser device according to claim 1, wherein the metal tubes in the condenser are orthogonally arranged.

23. The EHD condenser device according to claim 1, wherein the metal tubes in the condenser are alternatively arranged.

* * * * *